US011506117B2

(12) United States Patent
Frey

(10) Patent No.: US 11,506,117 B2
(45) Date of Patent: Nov. 22, 2022

(54) OUTBOARD MOTOR STABILIZER

(71) Applicant: Rich Frey, Owens Crossroads, AL (US)

(72) Inventor: Rich Frey, Owens Crossroads, AL (US)

( * ) Notice: Subject to any disclaimer, the term of this patent is extended or adjusted under 35 U.S.C. 154(b) by 0 days.

(21) Appl. No.: 17/007,932

(22) Filed: Aug. 31, 2020

(65) Prior Publication Data

US 2021/0396172 A1 Dec. 23, 2021

Related U.S. Application Data

(60) Provisional application No. 62/894,763, filed on Aug. 31, 2019.

(51) Int. Cl.

| | |
|---|---|
| ***F02B 61/04*** | (2006.01) |
| ***B63H 20/34*** | (2006.01) |
| ***B63H 20/12*** | (2006.01) |
| ***B63H 20/36*** | (2006.01) |
| ***B63H 20/10*** | (2006.01) |
| ***B63H 20/06*** | (2006.01) |

(52) U.S. Cl.

CPC ..... *F02B 61/045* (2013.01); *B63H 20/06* (2013.01); *B63H 20/10* (2013.01); *B63H 20/12* (2013.01); *B63H 20/34* (2013.01); *B63H 20/36* (2013.01)

(58) Field of Classification Search

CPC ..... F02B 61/045; B63H 20/06; B63H 20/10; B63H 20/12; B63H 20/34; B63H 20/36

See application file for complete search history.

(56) References Cited

U.S. PATENT DOCUMENTS

| | | | | |
|---|---|---|---|---|
| 1,537,362 | A * | 5/1925 | Maclellan | B62D 7/22 280/90 |
| 4,842,239 | A * | 6/1989 | Kinsey | B63H 20/36 248/351 |
| 2001/0044243 | A1* | 11/2001 | Thompson | B63H 20/36 440/55 |
| 2018/0001515 | A1* | 1/2018 | Meyer | B29C 45/0001 |

* cited by examiner

*Primary Examiner* — Stephen P Avila

(74) *Attorney, Agent, or Firm* — Patent Grove LLC; Tomas Friend

(57) ABSTRACT

An outboard motor stabilizer of unitary construction has a cylindrical body and an axially oriented cylindrical orifice with an opening at the bottom end of the body. The orifice has a diameter sized to fit onto a tilt rod of an outboard motor and is of a length that is longer than the tilt rod of the outboard motor.

18 Claims, 2 Drawing Sheets

OUTBOARD MOTOR STABILIZER

BACKGROUND OF THE INVENTION

Field of the Invention

The present invention relates to devices used to support an outboard motor and prevent damage during trailering, especially outboard motor supports that fit into trim pistons.

Description of Related Art

Outboard motors are normally attached to a boat transom through a hydraulic tilt and trim system. The motor is normally tilted forward with the propeller raised during boat transit and storage and when the boat is transitioned between water and land. Home made and commercially available devices used to support trailered outboard motors in the forward tilted position are often called transom savers because they are intended to prevent wear and damage to the boat transom during travel and storage.

Modern outboard motors are normally loaded onto a hydraulic tilt and trim piston system and modern outboard motor boats have transoms designed for heavy and powerful engines. With larger and heavier outboard engines, it is more important to reliably stabilize the outboard motor in order to prevent the outboard motor from rocking and twisting during transit and causing damage to the transom, motor mounts, and/or the outboard motor. Supporting the motor may additionally take pressure off of the hydraulic tilt and trim system.

One solution to the problem of stabilizing an outboard motor during trailering involves placement of a stabilizer on one or two trim pistons, or tilt rods, of a three ram trim/tilt system. Installation of this type of device involves trimming the outboard motor up, sliding the device over one or both tilt rods, and trimming the outboard motor down to apply pressure to the device sufficient to keep it in place. Examples of this type of transom saver include the T-H Marine Motor Stik™ Outboard Motor Support and the M-Y Wedge™ Motor Support. The Motor Stik™ is made of Aluminum tubing with molded Ethylene Propylene Diene Monomer (EDPM) rubber or nylon ends. The M-Y Wedge™ motor Support is made from EPDM rubber and plastic. Both devices have generally tubular structures with cushioning rubber ends. These cushioning materials are meant to seal the device at both ends and to absorb shocks transmitted from the trailer to the boat and motor.

BRIEF SUMMARY OF THE INVENTION

While existing transom saver devices provide the desired stabilization of outboard motors during trailer transport, drawbacks remain. The devices remain under significant compressive force while supporting the motor. Devices comprising combinations of hard outer sleeves and softer ends may wear or fail at the interfaces of the two materials when the device are under high compressive forces combined with vibration and shocks. Synthetic rubbers such as EDPM are resistant to ultraviolet aging and weathering but not to petroleum based solvents like gasoline.

The present invention overcomes the one or more of the above drawbacks by providing an outboard motor stabilizer of unitary construction that is resistant to solvents such as gasoline and resists compressive force, abrasion, weathering, and oxidation.

BRIEF DESCRIPTION OF THE DRAWINGS

The elements of the drawings are not necessarily to scale relative to each other, with emphasis placed instead upon clearly illustrating the principles of the disclosure. Like reference numerals designate corresponding parts throughout the several views of the drawings in which.

DETAILED DESCRIPTION OF THE INVENTION

All art specific terms used herein are intended to have their art-accepted meanings in the context of the description unless otherwise indicated. All non art specific terms are intended to have their plain language meaning in the context of the description unless otherwise indicated.

As used herein, terms such as "top," "bottom," "above," "below," "axial," "upward", "downward", "inner", "outer", or the like are used for the purpose of facilitating a description of the invention in reference to the drawings. "Unitary construction" is used to mean a single piece that is not made by the connection of two or more pieces to one another.

Figure 1:
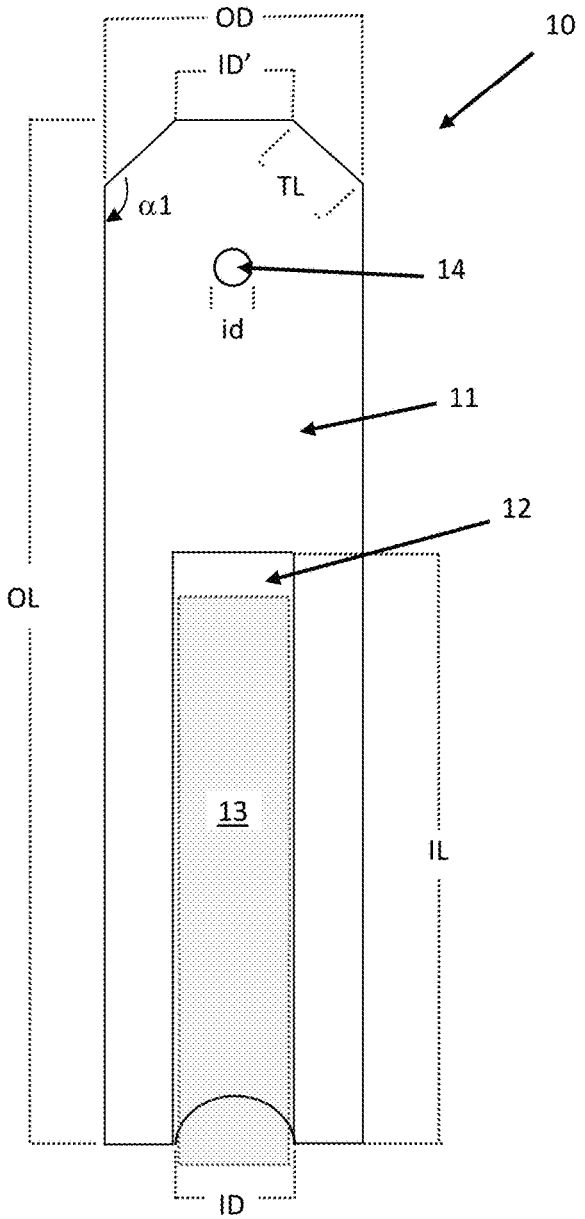
FIG. 1 is a cross-sectional side view of an embodiment of an outboard motor stabilizer.
Figure 4:
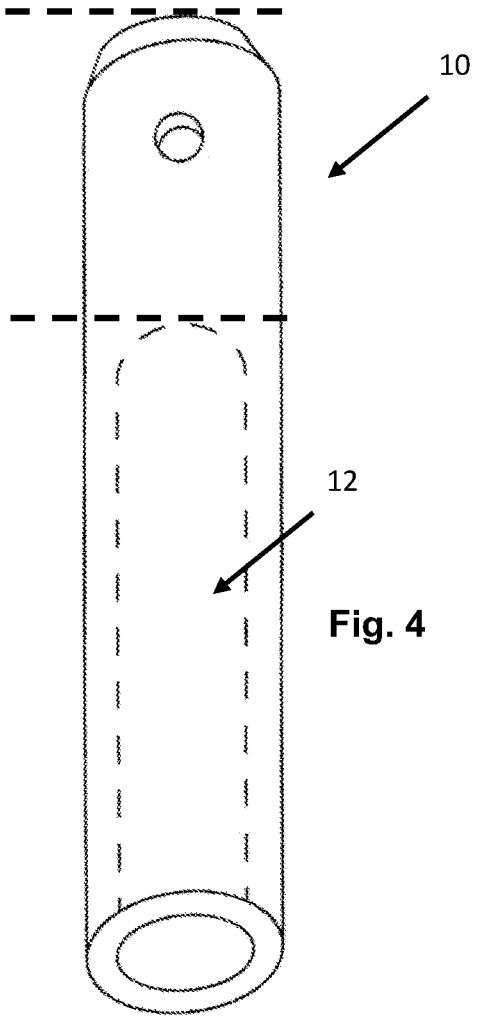
FIG. 4 is a bottom, front perspective view with inside cut reveal of an embodiment of an outboard motor stabilizer.

FIG. 1 is a lengthwise cross sectional view a most preferred embodiment of an outboard motor stabilizer (10). FIG. 4 is a corresponding perspective view using finer dashed lines to show the position and shape of the orifice (12) in the stabilizer and coarser dashed lines marking upper and lower boundaries of a solid portion of the body (11). The stabilizer (10) is of a unitary construction with a body (11) comprising a generally cylindrically shape and comprising a cylindrically shaped orifice (12) that opens at the bottom end of the body (11). The body is preferably made by injection molding a semicrystalline thermoplastic such as an Acetal, a Nylon, a Polyethelyne, a Polybutylene terephthalate, a Polypropylene, a Polyetheretherketone, a Polyethylene terephthalate, a PPS, or a PVDF, polymer, with nylon 6/6, or Poly[imino(1,6-dioxohexamethylene) iminohexamethylene], being most preferred. The body (11) is shown in the figures with an optional through hole (14), which may be made during an injection molding process or drilled afterward.

The stabilizer (10) is sized so that the diameter (ID) of the orifice allows the lower portion of the body (11) to slide onto the tilt rod of a tilt and trim system of an outboard motor. The stabilizer body length (OL) is chosen so that a solid portion of the body (11) from the top end of the stabilizer (10) to the top end of the orifice (12) provides strength sufficient to support the weight of the outboard motor when the motor is trimmed down to rest on the top end of the stabilizer and at a desired trim angle. The length of the orifice (IL) may be from 3 to 6 inches, for example 4.625 inches. The length of the body (OL) may be from 6 to 12 inches, 6 to 11 inches, 7 to 11 inches, 6 to 10 inches, or 7 to 10 inches, for example 8 inches. A ratio of the length of the body (OL) and a length of the orifice (IL) is preferably be between 1.5:1 and 2:1.

The diameter of the orifice (ID) may be from 0.5 to 0.8 inches or 0.6 to 0.7 inches. While the diameter may be selected to fit snugly over the tilt rod (13), a diameter of 0.6875 inches is preferred for the most common embodiment for the stabilizer to slide onto the most common cylinder and fit without wiggle. The length of the orifice (IL) is longer than the tilt rod (13) onto which the stabilizer (10) is placed so that no force is applied to the end of the tilt rod when the stabilizer is in place. The length of the orifice (IL) provides for a gap length between the end of the tilt rod (13) and upper end of the orifice (12). The length (IL) of the orifice may be from 3 to 6 inches, for example 4.625 inches. The combination of an orifice (12) with a solid upper portion of the body (11) provides several advantages over a stabilizer having a passageway open at both ends. The present invention provides greater strength and resistance to compressive force along the axial length of the stabilizer (10), assures proper orientation of the stabilizer on the tit rod (13), and allows for the shape of the top end to be optimized for different surfaces contacted by the top end of the stabilizer.

Figure 2:
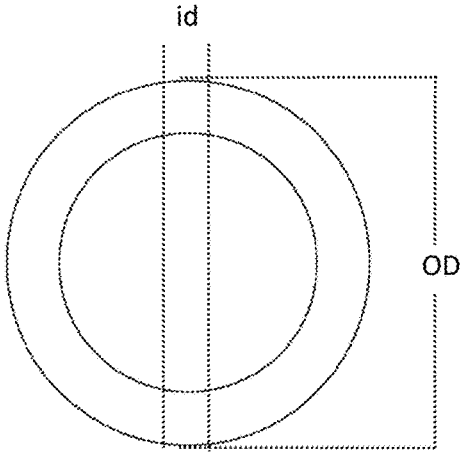
FIG. 2 is a top view of an embodiment of an outboard motor stabilizer.
Figure 3:
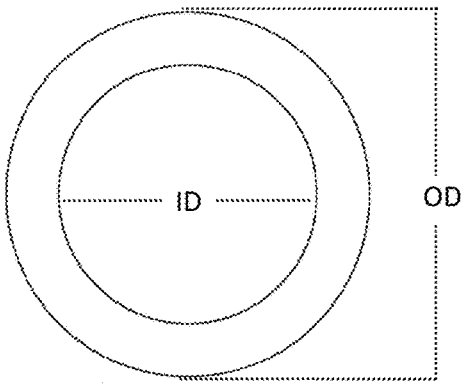
FIG. 3 is a bottom view of an embodiment of an outboard motor stabilizer.

FIGS. 2 and 3 show top and bottom views, respectively, of the embodiment shown in FIG. 1. The body (11) has an outer diameter (OD) in relation to the diameter (ID) of the orifice (12) that provides sufficient strength to resist compressive and other forces when in use. The body diameter (OD) may be from 1 to 2 inches, 1 to 1.6 inches, 1.1 to 1.5 inches, 1.2 to 1.4 inches, for example 1.25 inches or 1.5 inches. It is preferable that the OD exceeds the ID by 0.5 inches or more. The ratio of the diameter of the body around the orifice (OD) and the diameter of the orifice (ID) may be between 1.75:1 and 2:1.

Figure 5:
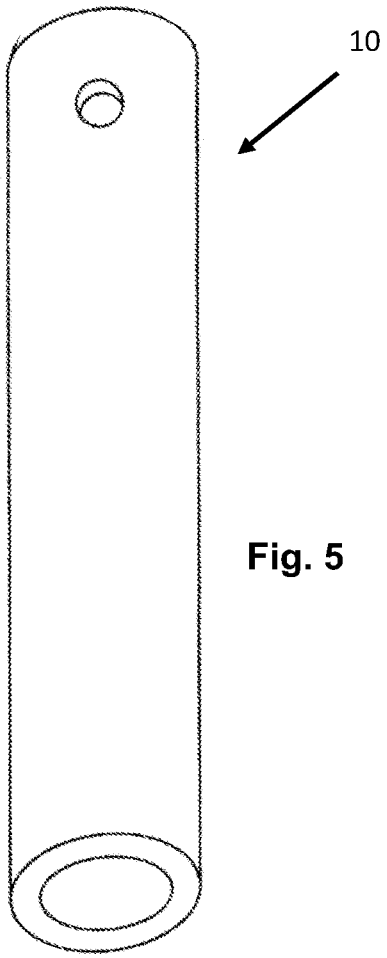
FIG. 5 is a bottom, front perspective view of an embodiment of an outboard motor stabilizer.
Figure 6:
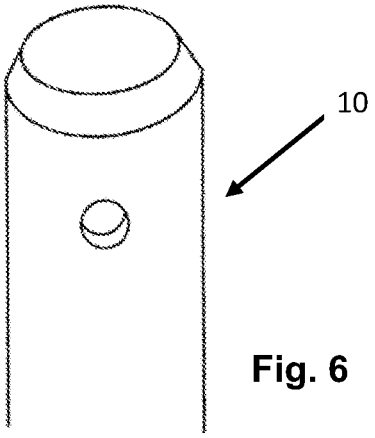
FIG. 6 is a is a top, front perspective view of an embodiment of an outboard motor stabilizer.

The lower end of the body (11) (FIGS. 1 and 3) is shown as having a preferred flat surface. The lower end of the body (11) may alternatively a donut shape, a beveled shape, or other shape. The upper end of the body (11) is shown as having a tapered, or beveled shape in FIG. 1 and as having a flat shape in FIG. 5. The taper is shown as having a taper angle ($\alpha 1$) and a taper length (TL). The taper angle ($\alpha 1$) shown in FIG. 1 is 45 degrees and the angle may be greater or smaller than this value to provide a longer or shorter taper length (TL) and resulting in a longer or shorter inner diameter (ID') at the upper end. FIG. 6 provides an elevated view of the stabilizer to show a beveled shape of the top end. The upper end of the body (11) may alternatively be flat, have a domed shape, a mushroom shape, or a wedge shape, or have a stair step shape with a central portion of the body extending upward beyond a perimeter portion. Additionally or alternatively, the upper end of the body (11) may be bifurcated to form a Y-shape or U-shape.

The stabilizer (10) may comprise a through hole (14) that may be used to connect the stabilizer to a cord, string, wire, or the like (not shown). It may be convenient, for example, to connect two stabilizers to one another with a length of string to keep them together. The string may also be used to attach one or a pair of stabilizers to a part of a boat or trailer when they are not in use.

The invention claimed is:

1. An outboard motor stabilizer for placement onto a tilt rod of a tilt and trim system for stabilizing an outboard motor during transport, said outboard motor stabilizer comprising:

a cylindrical body of unitary construction having a length of between 6 and 12 inches and an outer diameter of between 1 and 2 inches, wherein:

said body comprising an axially oriented cylindrical orifice having an opening at a bottom end of said body for receiving said tilt rod, said cylindrical orifice is between 3 and 6 inches in length, said cylindrical orifice is between 0.5 inches and 0.8 inches in diameter, a ratio of the length of the body and the length of the cylindrical orifice is between 1.5:1 and 2:1, and a ratio of the outer diameter of the body and the diameter of the cylindrical orifice is between 1.75:1 and 2:1.

2. The outboard motor stabilizer of claim 1, wherein the body is made of injection molded semicrystalline thermoplastic.

3. The outboard motor stabilizer of claim 1, wherein a top portion of the body has a tapered shape, a stair step shape, or a domed shape.

4. The outboard motor stabilizer of claim 3, wherein the top portion of the body has a tapered shape and a taper angle of 45 degrees.

5. The outboard motor stabilizer of claim 1, wherein a top portion of the body has a bifurcated shape, a mushroom shape, or a wedge shape.

6. The outboard motor stabilizer of claim 1, wherein a solid upper portion of the body comprises a hole passing radially through the body.

7. The outboard motor stabilizer of claim 2, wherein the body is made of nylon 6/6, or Poly[imino(1,6-dioxohexamethylene) iminohexamethylene].

8. The outboard motor stabilizer of claim 1, wherein the diameter of the cylindrical orifice is 0.6875 inches.

9. The outboard motor stabilizer of claim 1, wherein the length of the cylindrical orifice is 4.625 inches.

10. The outboard motor stabilizer of claim 1, wherein the outer diameter of the body is at least 0.5 inches greater than the diameter of the cylindrical orifice.

11. The outboard motor stabilizer of claim 1, wherein the body is configured to completely cover said tilt rod, when in use.

12. An outboard motor stabilizer for placement onto a tilt rod of a tilt and trim system to stabilize an outboard motor during transport, said outboard motor stabilizer consisting of:

a cylindrical body of unitary construction having a length of between 6 and 12 inches and an outer diameter of between 1 and 2 inches, wherein:

said body comprising an axially oriented cylindrical orifice having an opening at a bottom end of said body for receiving said tilt rod, said cylindrical orifice is between 3 and 6 inches in length, said cylindrical orifice is between 0.5 inches and 0.8 inches in diameter, a ratio of the length of the body and the length of the cylindrical orifice is between 1.5:1 and 2:1, and a ratio of the outer diameter of the body and the diameter of the cylindrical orifice is between 1.75:1 and 2:1.

13. The outboard motor stabilizer of claim 12, wherein the body is made of nylon 6/6, or Poly[imino(1,6-dioxohexamethylene) iminohexamethylene].

14. The outboard motor stabilizer of claim 12, wherein the diameter of the cylindrical orifice is 0.6875 inches.

15. The outboard motor stabilizer of claim 12, wherein the length of the cylindrical orifice is 4.625 inches.

16. The outboard motor stabilizer of claim 12, wherein the outer diameter of the body is at least 0.5 inches greater than the diameter of the cylindrical orifice.

17. The outboard motor stabilizer of claim 12, wherein the outer diameter of the body is at least 0.5 inches greater than the diameter of the cylindrical orifice.

18. The outboard motor stabilizer of claim 12, wherein the body is configured to completely cover said tilt rod, when in use.

* * * * *